US005626722A

United States Patent [19]

Huovila

[11] Patent Number: 5,626,722

[45] Date of Patent: May 6, 1997

[54] HEADBOX OF A PAPER/BOARD MACHINE

[75] Inventor: Jyrki Huovila, Muurame, Finland

[73] Assignee: Valmet Corporation, Helsinki, Finland

[21] Appl. No.: 457,327

[22] Filed: Jun. 1, 1995

[51] Int. Cl.[6] ..... D21F 1/06

[52] U.S. Cl. ..... 162/343; 162/258; 162/259

[58] Field of Search ..... 162/336, 343, 162/258, 259

[56] References Cited

U.S. PATENT DOCUMENTS

| | | | |
|---|---|---|---|
| 3,791,918 | 2/1974 | Koskimies et al. | 162/336 |
| 4,897,158 | 1/1990 | Weisshuhn et al. | 162/343 |
| 4,909,904 | 3/1990 | Kinzler | 162/343 |
| 5,030,326 | 7/1991 | Nous | 162/343 |
| 5,196,091 | 3/1993 | Hergert | 162/343 |
| 5,490,905 | 2/1996 | Huovila et al. | 162/343 |

FOREIGN PATENT DOCUMENTS

| | | | |
|---|---|---|---|
| 462472 | 12/1991 | European Pat. Off. | 162/343 |
| 4416898 | 11/1995 | Germany . | |
| 9322495 | 11/1993 | WIPO . | |

*Primary Examiner*—Karen M. Hastings
*Attorney, Agent, or Firm*—Steinberg, Raskin & Davidson, P.C.

[57] ABSTRACT

A headbox of a paper/board machine including a set of valves, each of which is arranged to distribute a flow to a different point in the direction of width of the headbox. Each valve is capable of regulating both the flow quantity of the flow departing from the valve and the consistency of the flow departing from the valve. Further, each valve includes an input line for the stock flow and an input line for a diluting flow, which is preferably a diluting-water line, and the flows are combined in the valve. The combined flow is passed into the headbox into connection with the stock flow present in the headbox coming from a stock inlet header to be mixed therewith. The headbox includes a turbulence generator arranged after and connected to the stock inlet header in the flow direction. The turbulence generator includes turbulence tubes which open into a slice duct, preferably a slice cone, from which the stock is passed onto a forming wire. The flows are passed from the valves into the turbulence tubes in the turbulence generator so that the overall combined flow is distributed into the turbulence tubes in the turbulence generator.

21 Claims, 6 Drawing Sheets

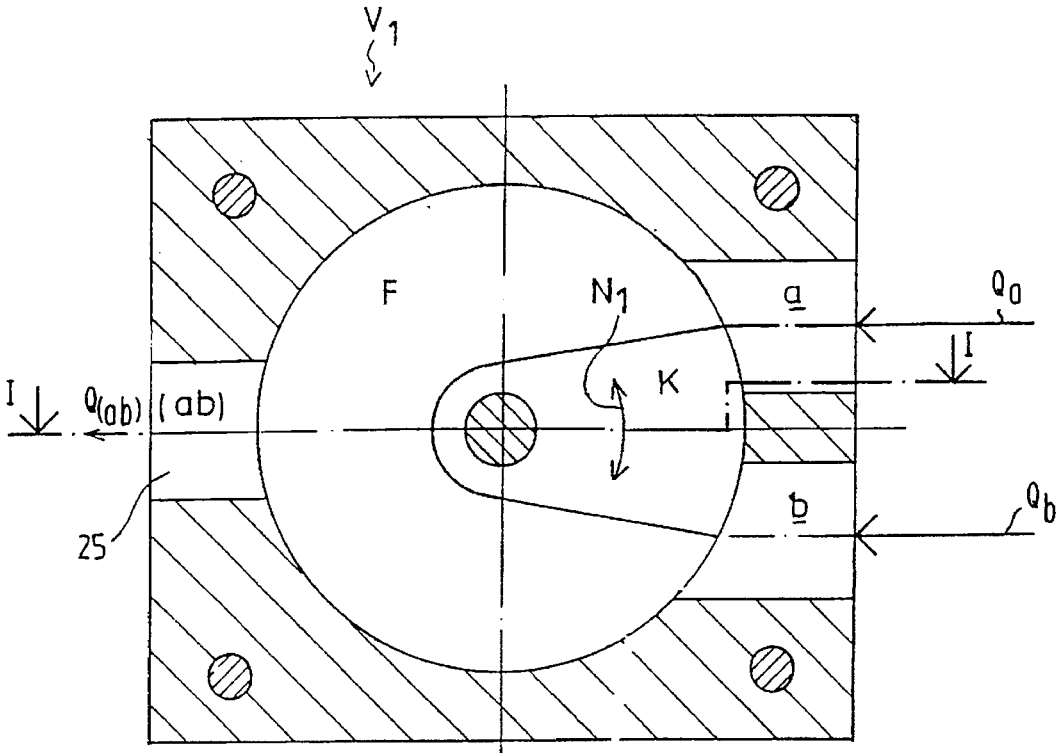
FIG.1 A
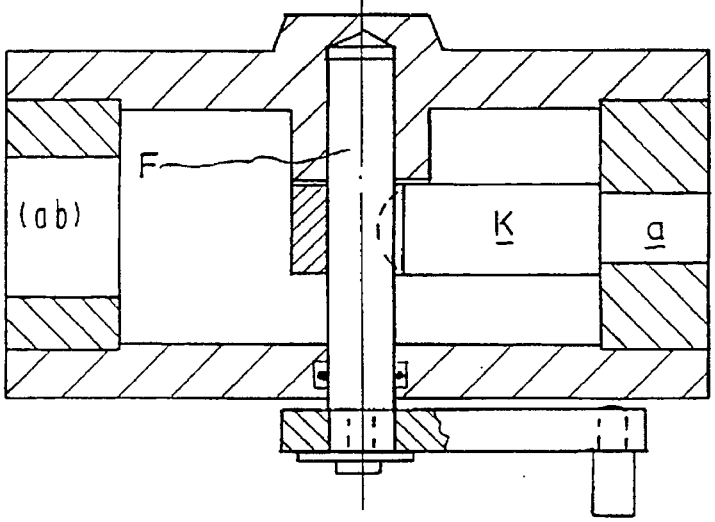
FIG.1 B
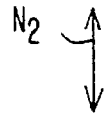

HEADBOX OF A PAPER/BOARD MACHINE

BACKGROUND OF THE INVENTION

The present invention relates to a headbox of a paper/board machine.

In the prior art, regulation of the headbox of a paper/board machine is known, wherein it is possible, by means of separate operations, to regulate the consistency of the stock and to regulate its fiber orientation. In the prior art, among other things, so-called dilution headboxes are known, in which the stock consistency is regulated across the web width by means of separate dilution flows.

OBJECTS AND SUMMARY OF THE INVENTION

It is an object of the present invention to provide a new and improved headbox for a paper/board machine.

The headbox for a paper machine in accordance with the present invention comprises an inlet header and a turbulence generator directly connected with the inlet header. The stock flow out of the turbulence generator is passed into a slice cone and further from the slice cone onto a forming wire in the paper/board machine. In the headbox construction in accordance with the present invention, in view of the direct connection between the inlet header and the turbulence generator, a tube bank and intermediate chamber are not employed, nor is a stilling chamber connected with the intermediate chamber employed. Instead of such constructions, in the headbox in accordance with the invention, a valve arrangement is utilized by whose means it is possible to regulate both the flow quantity and the flow consistency of the flow departing from the valve which is directed into turbulence tubes of the turbulence generator.

In the construction in accordance with the invention, the above flow coming from the valves in the arrangement, whose flow quantity and consistency have been regulated, is passed into the turbulence generator of the headbox so that this flow is passed into substantially all the tubes in the turbulence generator which extend in both a direction across the width of the headbox and vertically at each width location. The quantity of the flow coming from each of the valves can be regulated, and thus, by means of the regulation of these flows, it is possible to regulate the desired slice flow rate profile. The range of regulation of the valve is selected quite broad so that the largest variations in the distribution profile of the inlet header are covered by this range, i.e., by means of the width of the range of regulation of the valve it is possible to regulate the slice flow rate profile coming from the headbox.

Besides the slice flow rate profile, by means of the system of valves in accordance with the invention, it is additionally possible to regulate the consistency profile of the flow coming out of the headbox, and by its means, the grammage profile of the paper. According to the invention, to each regulation valve, a stock flow is passed directly from the stock inlet header, and a dilution water flow or equivalent is passed from the dilution-water inlet header or an equivalent tank for dilution water. In the valves, the flows are combined, and the sum or combined flow is passed into a respective one of the turbulence generator of the headbox. A sum or combined flow is distributed into each of the tubes in the turbulence generator, and in the preferred embodiment of the invention a distributor piece, preferably an oblong tube is used, which comprises outlet openings for the sum flow so as to pass the sum flow into the principal stock flow in the turbulence tubes coming from the inlet header. In this manner, the flow coming from the valves can be distributed into all the tubes in the turbulence generator.

In accordance with the invention, a headbox of a novel type has been formed, in which it has been possible to omit the conventional tube bank, because the distribution profile of the slice flow can be controlled reliably by means of the regulation valves. From the turbulence tubes, no such precision is required as in the prior art constructions but, by means of the valve regulation, it is possible to correct and to compensate for any faults that may occur in the tubes.

The invention will be described in the following with reference to some preferred embodiments of the invention illustrated in the figures in the accompanying drawings. The invention is however, not confined to the illustrated embodiments alone.

BRIEF DESCRIPTION OF THE DRAWINGS

The following drawings are illustrative of embodiments of the invention and are not meant to limit the scope of the invention as encompassed by the claims.

FIG. 1A shows a valve construction applied in the headbox construction of the present invention.

FIG. 1B is a sectional view of the valve taken along the line I—I in FIG. 1A.

DETAILED DESCRIPTION OF THE INVENTION

Figure 2A:
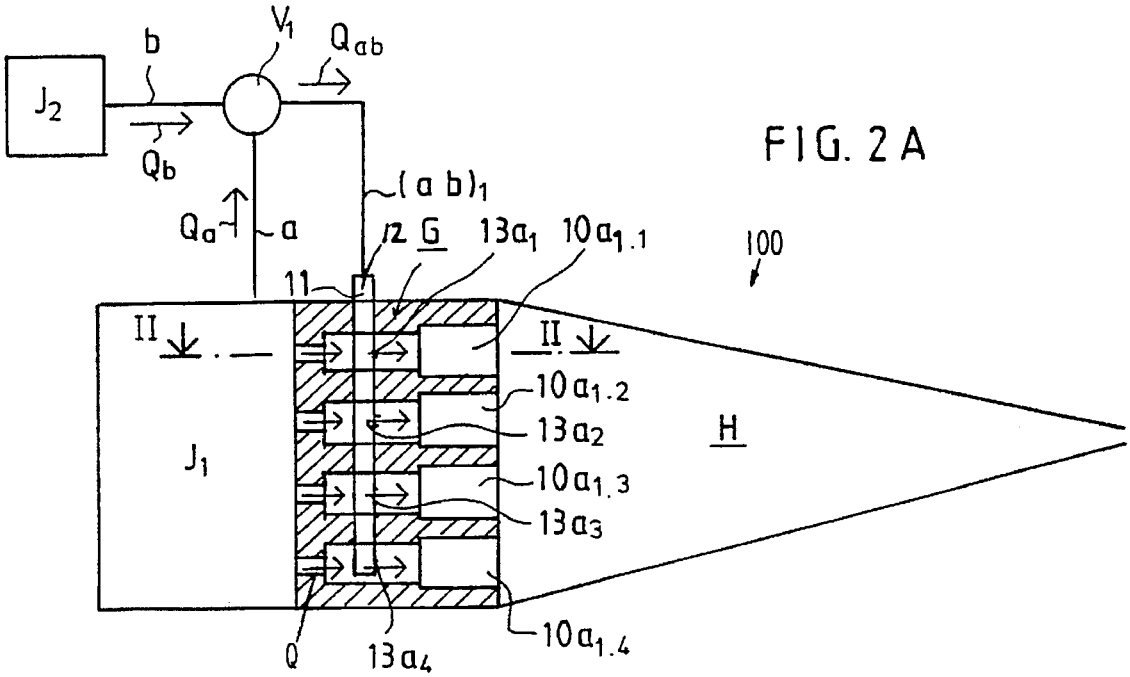
FIG. 2A is an illustration of principle of a headbox in accordance with the invention.

Referring to the accompanying drawings wherein the same reference numerals refer to the same or similar elements, FIGS. 1A and 1B show a valve construction which is the subject of at least one other patent application assigned to the assignee herein, e.g. U.S. patent application Ser. No. 08/269,348 filed Jun. 30, 1994 and now U.S. Pat. No. 5,490,905, by whose means it is possible to regulate both the quantity and the consistency of a flow independently from one another in a single unit. Since this valve unit is of substantial importance in the headbox in accordance with the present invention, the operation of the valve construction is described briefly with reference to FIGS. 1A and 1B.

FIGS. 1A and 1B illustrate a valve in which both the flow quantity is regulated and, independently from the flow quantity regulation, the concentration of the flow is regulated. A dilution-water flow $Q_b$ arrives from a dilution-water header $J_2$ (FIG. 2) along a duct b into a valve $V_1$, and a stock flow $Q_a$ arrives from a stock inlet header $J_1$ (FIG. 2A) along a duct a into the valve $V_1$. The valve $V_1$ comprises a rotatable spindle F, to which an obstruction part K is connected. When the spindle F is rotated (symbolized by arrow $N_1$ in FIG. 1A), the obstruction part K moves in relation to the ends of the ducts a and b connected to the valve $V_1$ and which lead into the space in the valve in which the spindle and obstruction part are situated. In this manner, rotation of the spindle F controls the amount of stock flow through duct a relative to the amount of dilution-water flow through duct b. Thus, for a substantially constant combined flow, the proportion or mixing ratio of dilution water to stock is varied.

When the spindle F is displaced along a linear path in the direction of its longitudinal axis (symbolized by arrow $N_2$ in FIG. 1B), the flow quantity is regulated with a certain mixing ratio, and as described above, when the spindle is rotated, the mixing ratio or consistency of the combined flow $Q_{ab}$ from the valve $V_1$ is regulated. The regulation of the mixing ratio is such that when one flow is increased, the other flow is reduced by the equivalent amount, in which case the quantity of the flow $Q_{ab}$ coming out of the valve via duct ab at that specific mixing ratio remains at an adjusted substantially constant value. The regulation of the flow quantity is achieved by the partial obstruction of the ends of ducts a and b which are obstructed by the obstruction part K by the same degree.

Figure 2B:
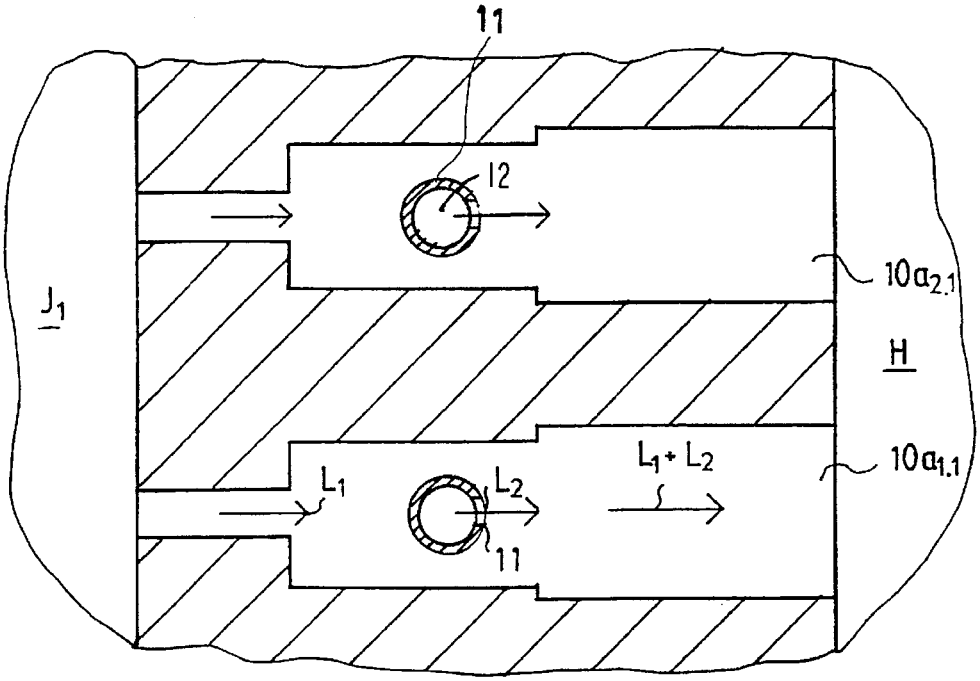
FIG. 2B is a sectional view taken along the line II—II in FIG. 2A.

FIGS. 2A and 2B show a construction in accordance with the present invention, in which the valve shown in FIGS. 1A and 1B or any other valve construction whatsoever is used that possesses corresponding functions and that performs the regulations stated above: flow quantity regulation and mixing ratio regulation, preferably independent of one another. In FIG. 2A, for the sake of the principle, just one of the valves $V_1, V_2, \ldots$ in the system of valves $V_{100}$ (FIG. 3A) is shown. There are a number of valves $V_1, V_2, \ldots$ placed side by side in a direction transverse to the flow direction of the stock through the headbox (also referred to as the direction of width of the headbox), and by their means the stock flow is regulated across the entire width of the headbox 100 (see FIG. 3A). As shown in FIG. 2A, from the header $J_2$ for dilution water, a dilution-water flow $Q_b$ is passed to the valve $V_1$, and from the stock header $J_1$ a stock flow $Q_a$ is passed to the valve $V_1$. The combined flow $Q_{ab}$ from the valve, whose flow quantity and consistency are regulated by operation of the valve, is passed via duct $(ab)_1$ further from the valve $V_1$ into a turbulence generator G placed after the inlet header $J_1$ and therefrom into turbulence tubes $\mathbf{10}a_{1.1}$, $\mathbf{10}a_{1.2}, \ldots$; $\mathbf{10}a_{2.1}, \mathbf{10}a_{2.2}, \ldots$ and from the turbulence tubes into a slice duct H, preferably a slice cone, and further onto the forming wire of the paper/board machine. From the set of valves $V_{100}$ which comprises valves $V_1, V_2, \ldots$ placed side by side, the parallel flows $Q_{ab}$ are passed into the turbulence generator G in such a way that the regulated flows $Q_{ab}$ arriving from the valves $V_1, V_2, \ldots$ of the set of valves $V_{100}$ are respectively distributed substantially into all the turbulence tubes $\mathbf{10}a_{1.1}, \mathbf{10}a_{1.2}, \ldots, \mathbf{10}a_{1.n}$; $\mathbf{10}a_{2.1}, \mathbf{10}a_{2.2}, \ldots, \mathbf{10}a_{2.n}$; $\mathbf{10}a_{3.1}, \mathbf{10}a_{3.2}, \ldots, \mathbf{10}a_{3.n}$ arranged in a respective vertical row at each width location in the turbulence generator G, i.e., flow $Q_{ab}$ via duct $(ab)_1$ is passed into turbulence tubes $\mathbf{10}a_{1.1}, \mathbf{10}a_{1.2}, \ldots, \mathbf{10}a_{1.n}$. Thus, by means of the flows arriving from the set of valves $V_{100}$, the entire slice flow rate profile of the headbox is regulated. According to the invention, the range of regulation of each valve and the range of regulation of the whole set of valves $V_{100}$ are selected so wide and broad that they can compensate for any faults that may occur in the flow rate through the turbulence generator G of the headbox. The ratio of the amount of the maximal flow $\Sigma Q_{ab}$ to the overall flow $\Sigma Q$ coming from the stock inlet header $J_1$, i.e. $\Sigma Q_{ab}/\Sigma Q$, is in the range from about 0.05 to about 0.15.

With reference to FIG. 2A, the line $(ab)_1, (ab)_2, \ldots, (ab)_n$ coming from each valve $V_1, V_2, \ldots$ (of which only line $(ab)_1$ coming from valve $V_1$ is shown) in the set of valves $V_{100}$ comprises a distributor piece 11 at its end. The distributor piece 11 comprises a central flow passage 12 and branch passages or openings $\mathbf{13}a_1, \mathbf{13}a_2$ opening from the flow passage 12. The flow that arrives from the valve $V_1$ is distributed, by means of the regulated valve flow $Q_{ab}$ passing from the valve $V_1$ into the distributor piece 11, evenly into the stock flow Q flowing in the turbulence tubes and coming directly from the inlet header $J_1$. The branch ducts or openings $\mathbf{13}a_1, \mathbf{13}a_2, \ldots$ in the flow passage 12 in the distributor piece 11 are opened in the flow direction $L_1$ of the main flow Q coming from the inlet header $J_1$. There is a large difference in speed between the flow Q and the regulated flow from the valve, so that the flows coming out of the branch ducts or openings $\mathbf{13}a_1, \mathbf{13}a_2, \ldots$ are mixed efficiently by the effect of the difference in speed between the flows Q and $Q_{ab}$. In order that the regulation valves $V_1, V_2$ are also capable of performing the regulation of the flow quantity, the mixing point coming from the valves must be placed in such a way in the turbulence tubes in the turbulence generator that there is a large differential pressure loss between the inlet header and the mixing point. In such a case, the inlet header does not compensate for the flow quantity of the unit to be regulated, and regulation of the quantity by means of the valves $V_1, V_2 \ldots$ is possible.

The connection point between the flow coming from the valve and the main flow is preferably placed in the turbulence generator in the area of the forward side of the turbulence generator in the turbulence tube so that the connecting of the flow $Q_{ab}$ with the turbulence tube takes place at the point of widening of the turbulence tube. The widening of the flow passage promotes the mixing together of the main flow Q and the regulated flow $Q_{ab}$.

FIG. 2B is a sectional view taken along the line II—II in FIG. 2A. The distributor piece 11 extends centrally into the turbulence tube $\mathbf{10}a_{1.1}$, in which case the stock flow $L_1$ coming from the inlet header $J_1$ flows from both sides of the distributor piece 11 from which the combined flow $L_2$ is released.

Figure 2C:
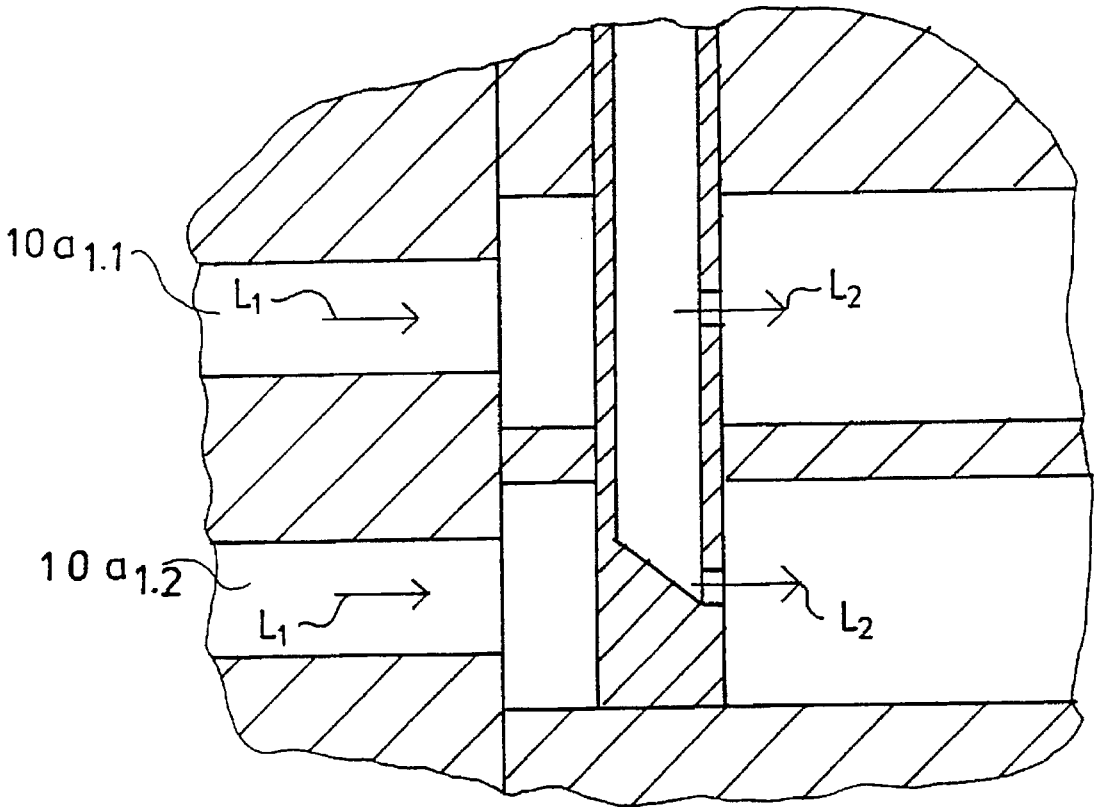
FIG. 2C shows the distribution of dilution fluid as shown in FIG. 2A on an enlarged scale in more detail.

FIG. 2C shows the distribution of dilution fluid from a distributor piece 11 as shown in FIG. 2A into a plurality of vertically arranged turbulence tubes $\mathbf{10}a_{1.1}, \mathbf{10}a_{1.2}$ on an enlarged scale and in greater detail.

Within the scope of the invention, an embodiment is also possible in which distributor pieces 11 are not employed but the flows $Q_{ab}$ coming from the valves $V_1, V_2, \ldots$ are distributed directly into vertical mixing chambers $E_1$ which are arranged at different points of width of the headbox of the paper machine. In this embodiment, there would be a mixing chamber for each set of vertically arranged turbulence tubes in the direction of width of the headbox.

The feed points of the flow lines coming from the valves $V_1, V_2, \ldots$ into the flow coming from the inlet header $J_1$ are selected so that there is a pressure loss between the feed point and the inlet header $J_1$.

A respective flow $Q_{ab}$ coming from a respective one of the valves $V_1, V_2, \ldots$ is passed into a respective one of the mixing chambers $E_1$ in the turbulence generator. Each of the mixing chambers $E_1$ is connected with a number of turbulence tubes of the turbulence generator at the inlet side and at the outlet side of the mixing chamber. In this manner, one inlet flow $Q_{ab}$ can be divided into a number of tubes in the turbulence generator. There are several mixing chambers $E_1$ separated from one another placed side by side across the width of the paper machine.

Figure 3A:
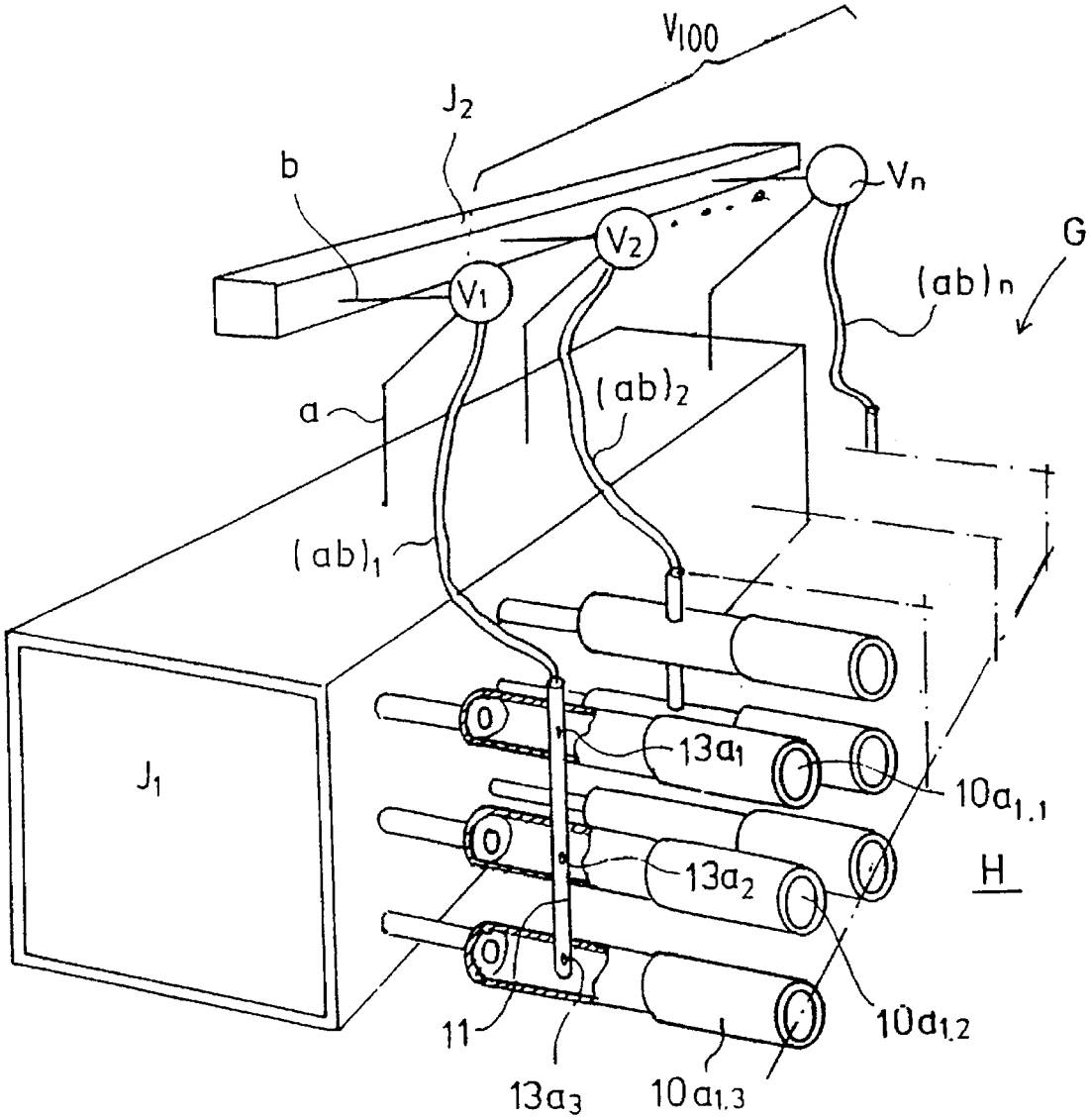
FIG. 3A illustrates a construction unit that comprises a number of valves across the width of the headbox, in which unit regulated flows are passed from the valves into the different points of width of the headbox of the paper/board machine.

FIG. 3A illustrates the arrangement of distribution in accordance with the invention of the flow coming from the valves $V_1, V_2$ into the turbulence tubes in the turbulence generator G. As shown in FIG. 3A, the set of valves $V_{100}$ comprises a number of valves $V_1, V_2, \ldots, V_n$ placed side by side, which valves represent for example the type of valve construction shown in FIGS. 1A and 1B, i.e., a valve by whose means both the flow quantity and the flow consistency can be regulated independently from one another.

Figure 3B:
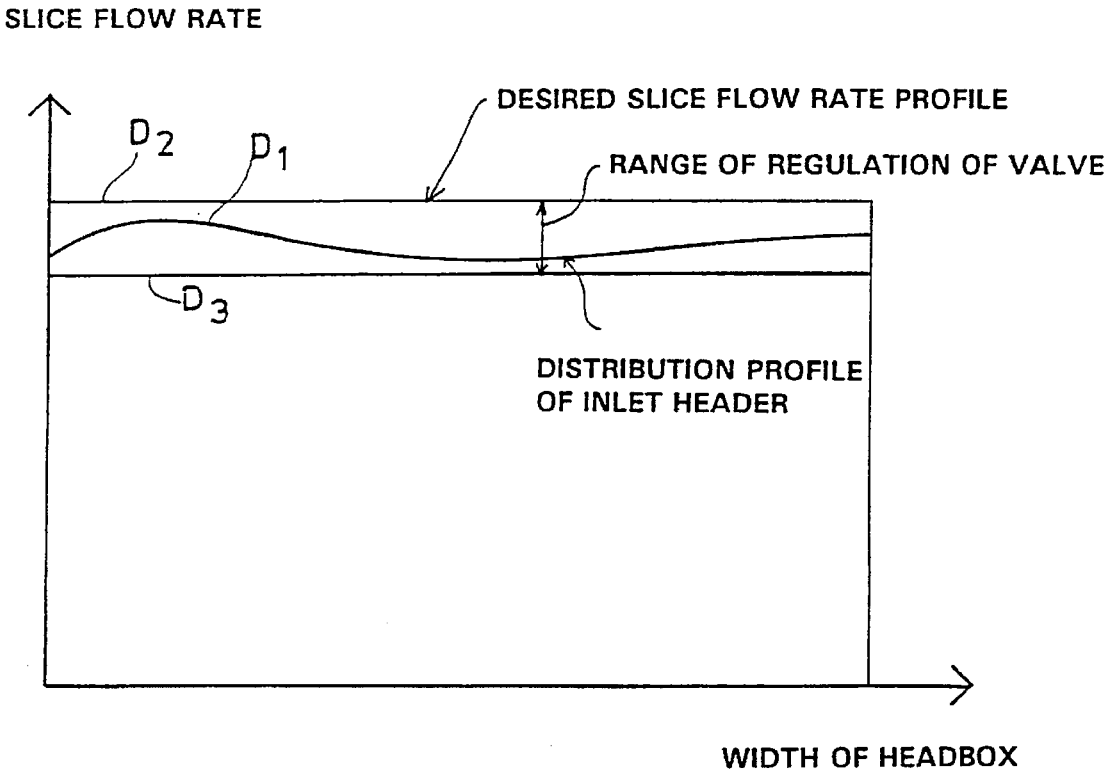
FIG. 3B illustrates a system of coordinates of slice flow rate—headbox width, in which the range of regulation of the regulation valves of the headbox in accordance with the invention is shown, the range of regulation being selected to be broad enough so that it corrects any undesirable disturbance produced by the turbulence generator of the headbox in the flow.

FIG. 3B illustrates the slice flow rate profile and the range of regulation of the valve in a system of coordinates representing the slice flow and the headbox width. Curve $D_1$ illustrates the slice flow rate profile produced by the stock header $J_1$ and the turbulence generator G alone. The desired slice flow rate profile is represented by the straight line $D_2$, and the range of regulation of the valve must be larger than the maximal range of variation occurring in the slice flow rate profile $D_1$, i.e., in FIG. 3B, the range of regulation of the valve $V_1, V_2 \ldots$ is the area between the straight lines $D_2$ and $D_3$. Thus, the range of regulation of the valve $V_1, V_2 \ldots$ must be selected wide enough so that, in the range, it is possible to compensate for a possibly uneven profile of the slice flow rate produced by the inlet header $J_1$, by the turbulence generator G and by the slice cone or slice duct H.

Figure 4:
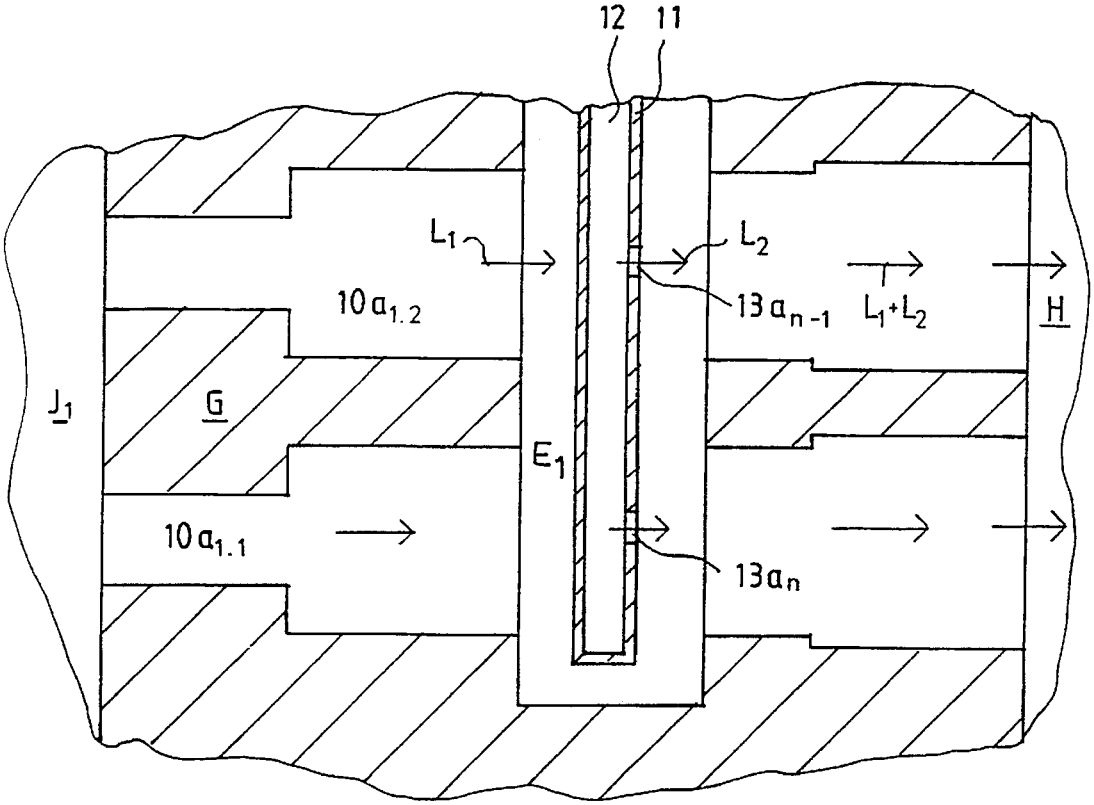
FIG. 4 shows a second arrangement of introduction of the regulated flow coming from the valve, arranged in connection with the turbulence generator of the headbox in accordance with the present invention, in which arrangement, at different points of width of the turbulence generator, there is a mixing chamber, in which the distributor pipe is arranged that is placed at the end of the flow coming from the valve.

FIG. 4 shows a second mode of arrangement of the distributor piece 11 in the turbulence generator G. In this arrangement, the distributor piece 11 is arranged in a separate vertical mixing chamber $E_1$ in the turbulence generator, which mixing chamber $E_1$ does not comprise partition walls. The flow that is passed out of the distributor piece 11, preferably out of the distributor pipe from the outlets $\mathbf{13}a_1$, $\mathbf{13}a_2, \ldots$ in its side face, is mixed with the flow entering into the mixing chamber $E_1$ from the inlet header $J_1$. The mixed flow is passed further in the tubes in the turbulence generator G. In this case, since the stock flow $L_1$ and the combined flow $L_2$ are the same for all of the vertically arranged turbulence tubes at that specific location along the width of the headbox, the mixing chamber thus may be open without preventing mixing of the different flows.

The examples provided above are not meant to be exclusive. Many other variations of the present invention would be obvious to those skilled in the art, and are contemplated to be within the scope of the appended claims.

I claim:

1. A headbox of a paper/board machine, comprising a stock inlet header arranged at an initial end of the headbox and providing a first and second stock flow having the same concept, a tube bank coupled to said stock inlet header and arranged after said stock inlet header in a flow direction of said first stock flow, said tube bank comprising a plurality of tubes having inlets for receiving said first stock flow from said stock inlet header, said tubes of said tube bank situated alongside one another in a direction transverse to the flow direction of said first stock flow across substantially the entire width of the headbox whereby individual ones of said tubes at a first location in the transverse direction are fluidly isolated from individual ones of said tubes at a second location in the transverse direction, a plurality of valves, each of said valves having a first input flow line for receiving said second stock flow from said stock inlet header and a second input flow line for receiving a diluting flow, said second stock flow and said diluting flow being combined in said valve to form a combined flow, passing means for passing the combined flow from a respective one of said valves into at least one of said tubes in said tube bank arranged only at a single respective location in the direction transverse to the flow direction of said first stock flow to mix with said first stock flow from said stock inlet header, said passing means being arranged to pass the combined flow into said at least one of said tubes at a feeding point located between said inlet of said at least one of said tubes and an outlet of said at least one of said tubes, each of said valves comprising regulating means for regulating the quantity of the combined flow and the consistency of the combined flow independent of one another such that the quantity and consistency of the combined flow from each of said valves is independently regulatable to provide a stock flow rate profile and consistency profile across the width of the headbox, pressure loss means for creating a pressure loss in said first stock flow arranged between said stock inlet header and said feeding point, and a slice duct coupled to said tube bank and arranged after said tube bank in the flow direction of said first stock flow, said slice duct receiving the stock from said tubes and discharging the stock from the headbox.

2. The headbox of claim 1, wherein said passing means comprise a plurality of distributor pieces, each of said distributor pieces extending into at least one of said tubes to define said feeding point at which the combined flow from said valve is released into said at least one of said tubes.

3. The headbox of claim 1, wherein said passing means comprise a flow line connected to each of said valves, and a distributor piece connected to each of said flow lines, each of said distributor pieces extending into at least one of said tubes, said distributor pieces comprising a central flow passage and at least one branch duct opening into said central flow passage, the combined flow being released into said at least one tube through a respective one of said at least one branch duct.

4. The headbox of claim 3, wherein at least one of said distributor pieces is passed through at least two of said tubes arranged vertically one above the other, said at least one distributor piece passing centrally through each of said at least two tubes, said branch ducts openings into said at least two tubes.

5. The headbox of claim 3, wherein a mixing chamber is defined in said tube bank, a plurality of said tubes opening into said mixing chamber, one of said distributor pieces being arranged in said mixing chamber.

6. The headbox of claim 5, further comprising a plurality of said mixing chambers defined in said tube bank and separated from one another, a plurality of said tubes opening into each of said mixing chambers, one of said distributor pieces being arranged in each of said mixing chambers.

7. The headbox of claim 6, wherein said mixing chambers are arranged at the locations of said tubes in the direction transverse to the flow direction of said first stock flow.

8. The headbox of claim 3, wherein each of said distributor pieces has a terminal portion situated within one of said at least one tubes into which said distributor piece extends.

9. The headbox of claim 1, wherein the ratio of the maximal overall flow from said valves to the overall flow of said first stock flow from said stock inlet header through said tubes is in the range from about 0.05 to about 0.15.

10. The headbox of claim 1, wherein said tube bank comprises a turbulence generator directly connected to said stock inlet header such that each of said tubes has a first end in fluid communication with said stock inlet header.

11. The headbox of claim 1, further comprising a dilution water header and ducts extending therefrom, said dilution water header supplying the diluting flow to said valves through said ducts.

12. The headbox of claim 1, wherein said stock inlet header comprises ducts, said second stock flow being passed from said stock inlet header to said valves through said ducts.

13. The headbox of claim 1, wherein the diluting flow is a diluting water flow.

14. The headbox of claim 1, wherein said regulating means comprise a spindle arranged in a housing of said valve, said spindle being independently movable in a first direction to vary a mixing ratio of the second stock flow and the diluting flow and in a second direction to vary the quantity of both the second stock flow and the diluting flow in the combined flow.

15. A headbox of a paper/board machine, comprising a stock inlet header arranged at an initial end of the headbox and providing a first stock flow, a tube bank coupled to said stock inlet header and arranged after said stock inlet header in a flow direction of said first stock flow, said tube bank comprising a plurality of tubes having inlets for receiving said first stock flow from said stock inlet header, a plurality of valves, each of said valves having an input flow line for receiving a second stock flow and an input flow line for receiving a diluting flow, said second stock flow and said diluting flow being combined in said valve to form a combined flow, passing means for passing the combined flow from a respective one of said valves into at least one of said tubes in said tube bank arranged at a respective location in a direction transverse to the flow direction of said first stock flow to mix with said first stock flow from said stock inlet header, said passing means comprising a flow line connected to each of said valves and a distributor piece connected to each of said flow lines, each of said distributor pieces extending into at least one of said tubes and comprising a central flow passage and at least one branch duct opening into said central flow passage, the combined flow being released into said at least one of said tubes through a respective one of said branch ducts, at least one of said distributor pieces being passed through at least two of said tubes arranged vertically one above the other, said branch ducts of said at least one distributor piece opening into said at least two tubes, and a slice duct fluidly coupled to said tube bank, said slice duct receiving the stock from said tubes and discharging the stock from the headbox.

16. The headbox of claim 15, wherein said plurality of tubes extend in a direction transverse to the flow direction of said first stock flow across substantially the entire width of the headbox whereby individual ones of said tubes at a first location in the transverse direction are isolated from individual ones of said tubes at a second location in the transverse direction, said passing means being arranged to pass the combined flow into said at least one of said tubes at a feeding point located between said inlet of said at least one of said tubes and an outlet of said at least one of said tubes, each of said valves comprising regulating means for regulating the quantity of the combined flow and the consistency of the combined flow independent of one another such that the quantity and consistency of the combined flow from each of said valves is independently regulatable to provide a stock flow rate profile and consistency profile across the width of the headbox, further comprising pressure loss means for creating a pressure loss in said first stock flow arranged between said stock inlet header and said feeding point.

17. A headbox of a paper/board machine, comprising a stock inlet header arranged at an initial end of the headbox and providing a first stock flow, a tube bank coupled to said stock inlet header and arranged after said stock inlet header in a flow direction of said first stock flow, said tube bank comprising a plurality of tubes each having an inlet for receiving said first stock flow from said stock inlet header and means defining a mixing chamber, at least two of said tubes being in flow communication with said mixing chamber, a plurality of valves, each of said valves having an input flow line for receiving a second stock flow and an input flow line for receiving a diluting flow, said second stock flow and said diluting flow being combined in said valve to form a combined flow, passing means for passing the combined flow from a respective one of said valves into at least one of said tubes in said tube bank arranged at a respective location in a direction transverse to the flow direction of said first stock flow to mix with said first stock flow from said stock inlet header, said passing means comprising a flow line connected to each of said valves and a distributor piece connected to each of said flow lines, at least one of said distributor pieces being arranged in said mixing chamber such that the combined flow from a respective one of said valves is released into said mixing chamber, and a slice duct fluidly coupled to said tube bank, said slice duct receiving the stock from said tubes and discharging the stock from the headbox.

18. The headbox of claim 17, wherein said plurality of tubes extend in a direction transverse to the flow direction of said first stock flow across substantially the entire width of the headbox whereby individual ones of said tubes at a first location in the transverse direction are isolated from individual ones of said tubes at a second location in the transverse direction, said passing means being arranged to pass the combined flow into said at least one of said tubes at a feeding point located between said inlet of said at least one of said tubes and an outlet of said at least one of said tubes, each of said valves comprising regulating means for regulating the quantity of the combined flow and the consistency of the combined flow independent of one another such that the quantity and consistency of the combined flow from each of said valves is independently regulatable to provide a stock flow rate profile and consistency profile across the width of the headbox, further comprising pressure loss means for creating a pressure loss in said first stock flow arranged between said stock inlet header and said feeding point.

19. The headbox of claim 17, further comprising a plurality of said mixing chambers defined in said tube bank and separated from one another, a plurality of said tubes opening into each of said mixing chambers, one of said distributor pieces being arranged in each of said mixing chambers.

20. The headbox of claim 19, wherein said mixing chambers are arranged at the locations of said tubes in the direction transverse to the flow direction of said first stock flow.

21. A headbox of a paper/board machine, comprising a stock inlet header arranged at an initial end of the headbox and providing a first stock flow, a tube bank coupled to said stock inlet header and arranged after said stock inlet header in a flow direction of said first stock flow, said tube bank comprising a plurality of tubes having inlets for receiving said first stock flow from said stock inlet header, a plurality of valves, each of said valves having an input flow line for receiving a second stock flow and an input flow line for receiving a diluting flow, said second stock flow and said diluting flow being combined in said valve to form a combined flow, passing means for passing the combined flow from a respective one of said valves into at least one of said tubes in said tube bank arranged at a respective location in a direction transverse to the flow direction of said first stock flow to mix with said first stock flow from said stock inlet header, said passing means comprising a plurality of tubular distributor pieces, each of said distributor pieces extending into an interior of at least one of said tubes to define a feeding point within said interior of said at least one of said tubes at which the combined flow from said valve is released into said at least one of said tubes, and a slice duct coupled to said tube bank and arranged after said tube bank in the flow direction of said first stock flow, said slice duct receiving the stock from said tubes and discharging the stock from the headbox.

* * * * *